US005961721A

United States Patent [19]

Feldkamper et al.

[11] Patent Number: 5,961,721

[45] Date of Patent: Oct. 5, 1999

[54] ADHESIVE APPLICATION DEVICE

[75] Inventors: Richard Feldkamper; Rudiger Duwendag, both of Lengerich; Horst Rautenberg, Lienen, all of Germany

[73] Assignee: Windmoeller & Hoelscher, Lengerich/Westf., Germany

[21] Appl. No.: 08/917,907

[22] Filed: Aug. 27, 1997

[30] Foreign Application Priority Data

Aug. 27, 1996 [DE] Germany ..... 196 34 594

[51] Int. Cl.[6] ..... B05C 1/00

[52] U.S. Cl. ..... 118/222; 118/256; 118/261; 156/578

[58] Field of Search ..... 156/578; 118/222, 118/256, 261; 427/428, 207.1

[56] References Cited

U.S. PATENT DOCUMENTS

| | | | |
|---|---|---|---|
| 5,702,525 | 12/1997 | Lion | 118/200 |
| 5,858,091 | 1/1999 | Feldkamper et al. | 118/200 |

FOREIGN PATENT DOCUMENTS

| | | |
|---|---|---|
| 18 83 569 | 7/1963 | Germany . |
| 2 031 197 | 5/1971 | Germany . |
| 26 52 133 | 5/1978 | Germany . |
| 40 36 726 | 5/1992 | Germany . |
| 19532582 C1 | 12/1996 | Germany . |

*Primary Examiner*—Laura Edwards
*Attorney, Agent, or Firm*—Evenson, McKeown, Edwards & Lenahan, PLLC

[57] ABSTRACT

An adhesive application device is provided with suspended and free floating adhesive rollers positioned on a support plate. The rollers form an adhesive chamber with a housing placed against them. The support plate is positioned in the machine frame, laterally from the adhesive rollers, so that it can be swung around a vertical shaft. The support plate is provided with support pieces, upon which the housing is attached in a removable manner, so that good accessibility is provided and so that the adhesive application device can be maintained properly and cleaned quickly in a simple manner.

20 Claims, 5 Drawing Sheets

ADHESIVE APPLICATION DEVICE

BACKGROUND OF THE INVENTION

1. Field of the Invention

This invention relates to an adhesive application device with suspended and free floating adhesive rollers that are positioned on a support plate. Together with a housing placed on the plate, the rollers form an adhesive chamber. The support plate is positioned laterally from the adhesive rollers around a vertical shaft that can be swung in a machine frame.

2. Description of Related Art

An adhesive application device of this kind is known, for example, from DE-195 32 582.6. Typically, known adhesive application devices can be swung out in order to make accessibility easier. However, such devices must be taken apart in a complicated and laborious way for cleaning purposes.

SUMMARY OF THE INVENTION

A primary object of the invention is to provide an adhesive application device of the kind mentioned initially that can be maintained and cleaned in a simple manner and quickly and which has good accessibility.

This object is accomplished, according to the invention, by providing an adhesive application device of the kind mentioned initially with a supporting plate having supporting pieces upon which a housing is attached in a removable manner.

The adhesive application device according to the invention can be maintained and cleaned in a simple manner and quickly simply by removing the housing so that the adhesive application device, after renewed attachment of the housing, can immediately be swung back into its operating position.

According to a preferred embodiment, on the support plate, the housing has laterally grasping supports or pins. The housing is provided with a clip that protrudes laterally over the housing and that can be screwed together with the supports or pins. The housing can be removed by merely separating the clip.

According to another aspect of the invention, the support plate can be equipped with a toothed belt disk that is attached to a position shaft with shaft pins, protruding over the support plate, which can be coupled to a motor located in a fixed frame. An endless toothed belt, driving the adhesive rollers, runs over the toothed belt disk. The motor coupling is designed so that it will be released as the support plate is swung out and coupled when the support plate is swung in.

The adhesive rollers are positioned on the support plate in a practical manner. The adhesive rollers can be placed on pins connected with the support plate.

According to a preferred embodiment, the adhesive rollers are positioned on the pins by two roller bearings. The upper roller bearings can be shifted while the lower roller bearings are fixed. As a result, the bearings can be tensible against the ring steps of the pins by screws, washers, and springs that can be screwed into the pins. The arrangement of the springs permits one to set the adhesive rollers in their axial positions by working the screws. In this way, the rollers can be placed in a sealing manner against the floor plate of the housing and the sealing cap can be adjusted. This type of positioning furthermore offers the advantage of positioning the adhesive rollers roughly in a middle area on the pins so that one can prevent the floating positioned glue rollers from spreading apart from each other along their lower ends.

In order to increase the sealing effect, one can place wedge-shaped ascending grooves in the floor plate of the housing which rests against fronts of the adhesive rollers. The grooves can be placed in the rim area of the front with respect to the roller gap and the inlet-side vertical limiting edge of the side wall of the housing. These grooves cause any possibly leaking adhesive to again be drawn into the adhesive chamber by way of a hydrodynamic effect.

In the support plate, above the segment of a pin serving to position an adhesive roller, a part of the pin, eccentric with respect to the segment, is rotatably positioned. It is possible to swing the part of the pin by a pressure medium piston-cylinder unit. This swingability permits the gap between the adhesive rollers to be set in accordance with the desired application thickness and also to close completely.

BRIEF DESCRIPTION OF THE DRAWINGS

An exemplary embodiment of the invention will be described in greater detail below with the help of the drawings.

DESCRIPTION OF THE PREFERRED EMBODIMENT

Figure 1:
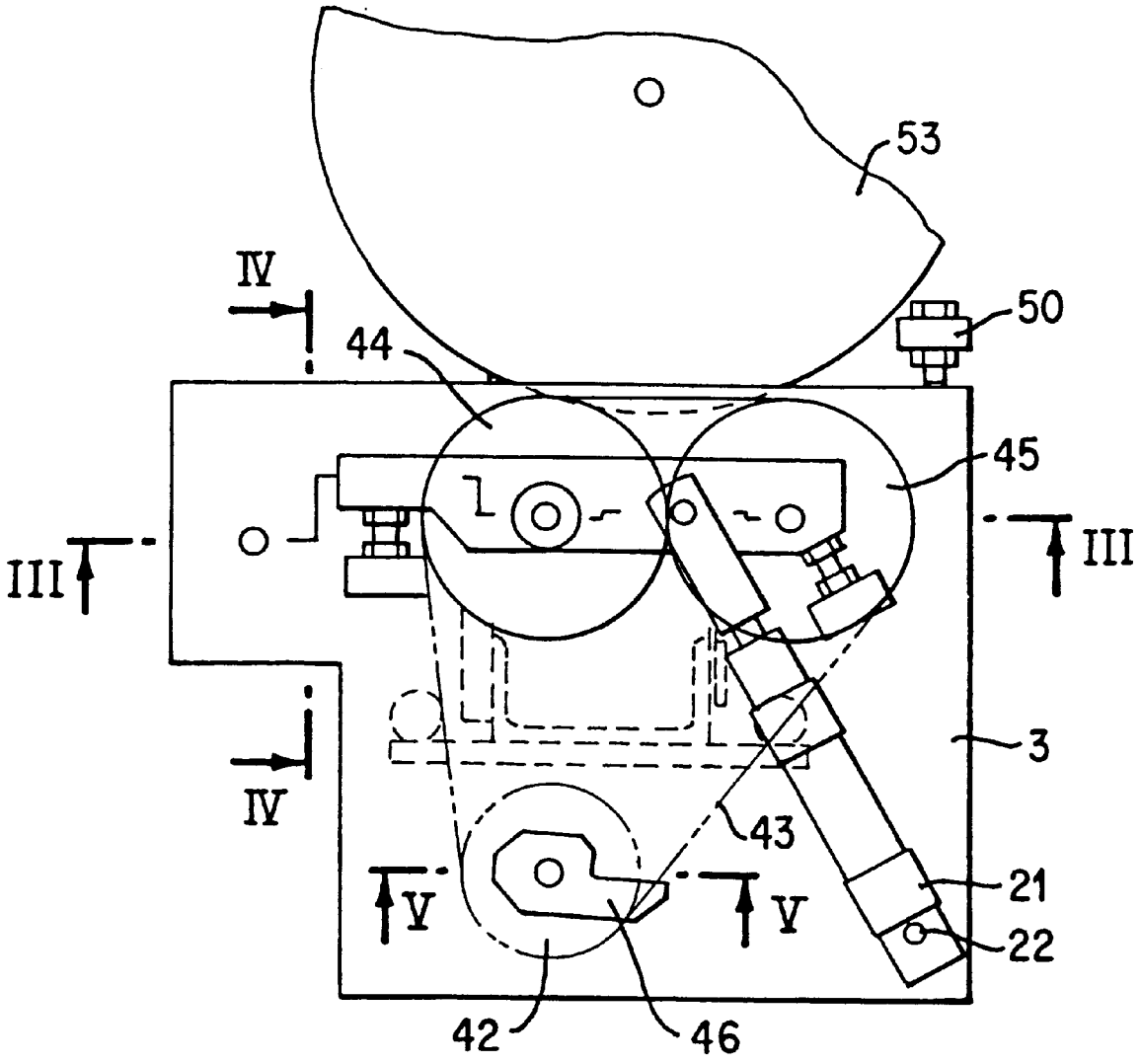
FIG. 1 shows a top view of the adhesive application device.
Figure 2:
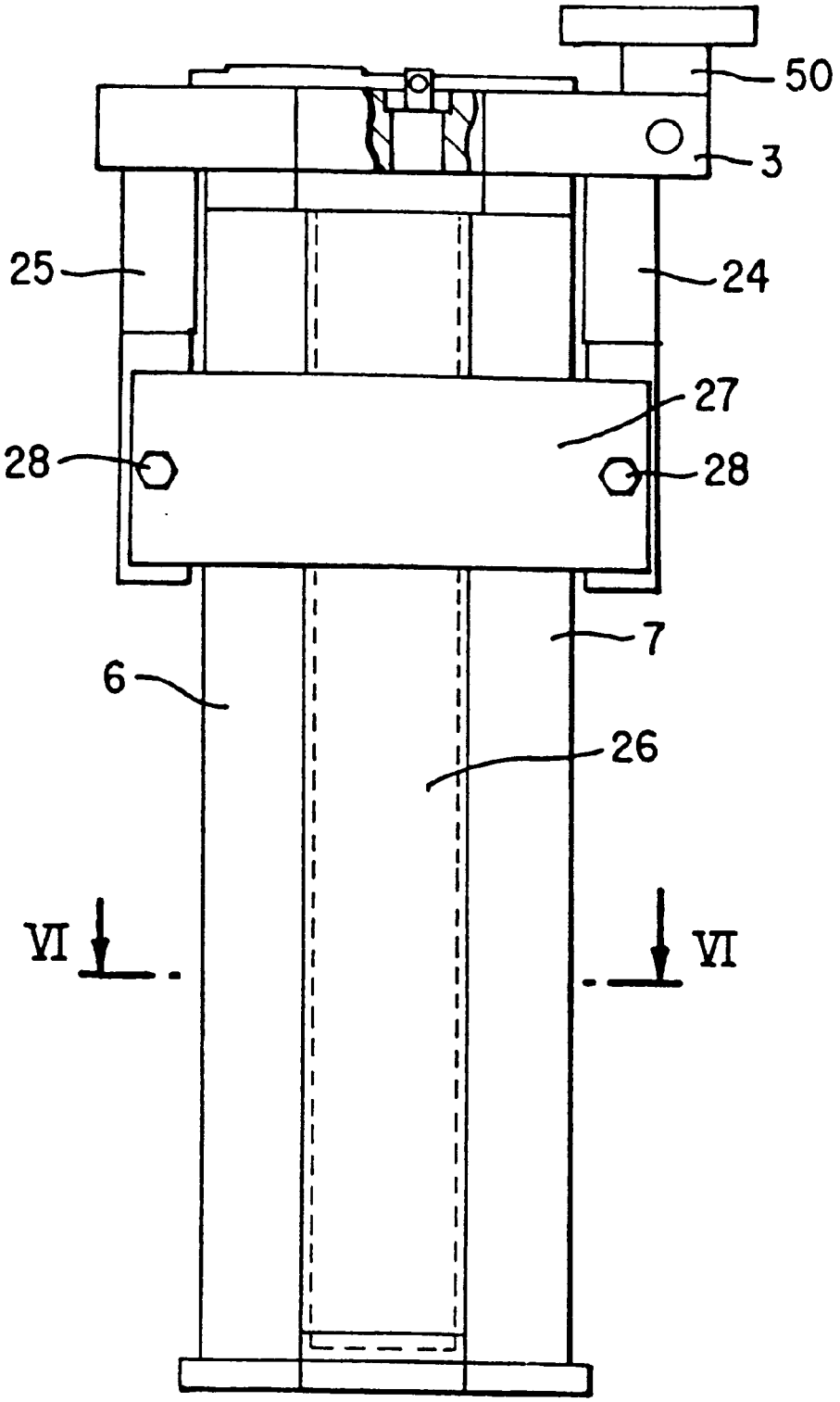
FIG. 2 is a rear view of the adhesive application device shown in FIG. 1.
Figure 3:
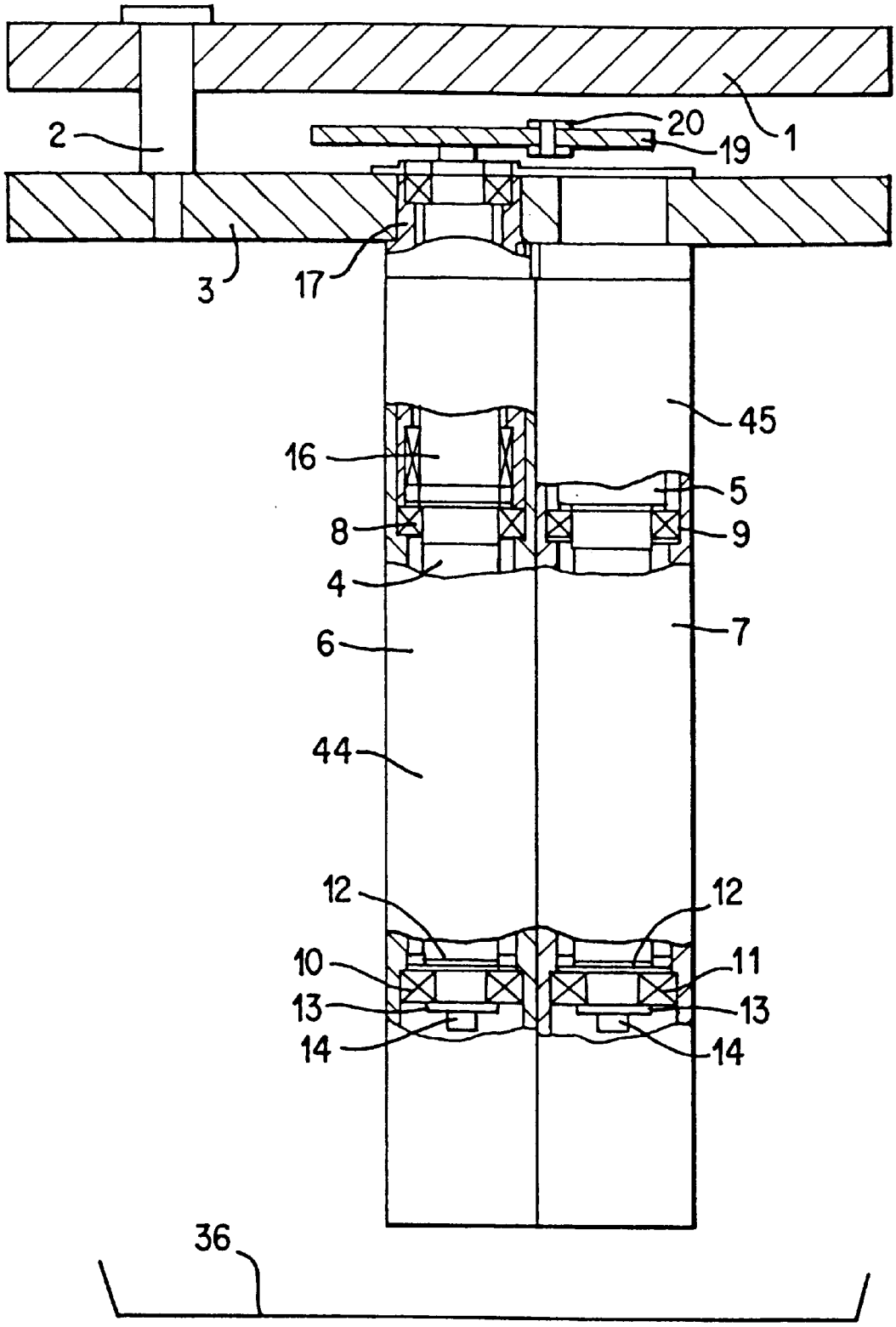
FIG. 3 is a profile through the adhesive application device along the line III—III in FIG. 1.
Figure 4:
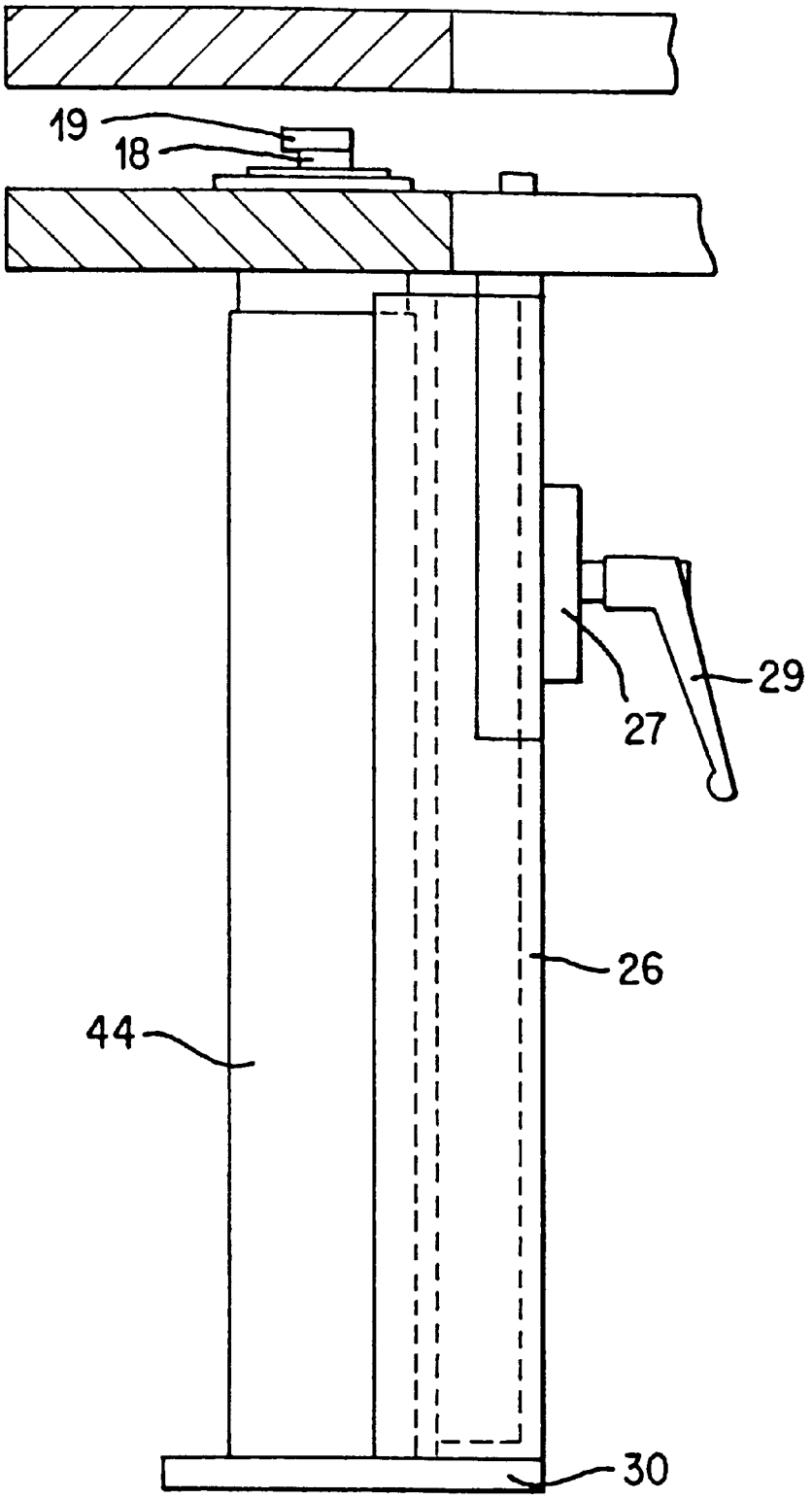
FIG. 4 is a side view of the adhesive application device shown in FIG. 3.

On a support or plate 1 of a machine frame, a support plate 3 is positioned. The support plate 3 can be swung around a vertical pin 2. Two mutually parallel pins 4 and 5 are retained in the support plate 3. On these pins, adhesive application rollers 6, 7 are rotatably positioned via roller bearings. Two roller bearings are provided for each application roller. Specifically, the adhesive application rollers are rotatably positioned via the upper mobile bearings 8, 9 and the lower bearings 10, 11 having outer rings which are fixed via clamping rings on a ring step of the adhesive rollers and inner rings which are supported via plate springs 12 on ring steps of the pins. The inner rings of the roller bearings 10, 11 can be tensed by washers 13 against plate springs 12 with fastening screws 14.

The pin 4 is provided with an eccentric upper segment 16. The segment 16 is positioned by roller bearings, in a rotatable but axially unmovable fashion, in a bushing 17 that is fastened in a borehole of the support plate 3. A radial lever 19 is attached to a peg 18 of the pin 4 and the segment 16. The peg passes through the support plate 3. Upon the radial lever 19, a piston rod 20 of a pneumatic cylinder 21 is hinged. The cylinder 21 is positioned swingably around a peg 22 on the support plate 3. The pin 4 can be rotated by the pneumatic cylinder 21 so that the width of the gap, formed between adhesive rollers 6, 7, can be adjusted. The gap can also be closed completely.

Parallel to bearing pins 4, 5, retaining pins 24, 25 are attached to support plate 3. These retaining pins are used to retain housing 26 of the adhesive chamber. The rear wall of the housing 26 is connected with a crosswise extending clip 27. Both ends of the clip 27 protrude over the housing. The clip 27 is provided with fastening boreholes through which fastening screws 28 are screwed into the threaded boreholes of retaining pins 24, 25. The fastening screws 28 are, in a practical manner, made as tommy screws.

Housing 26 has a lower closing plate 30 on which the lower fronts of adhesive rollers 6, 7 are supported in a sealing manner. Worked into floor plate 30 are circle-arch-shaped grooves 31, 32 in the rim area of the fronts of the adhesive rollers 6, 7. The grooves 31 rise, wedge-shaped, toward the inlet-side vertical limiting edge of a side wall 33 of the housing 26 and toward the roller gap.

A tub 36 is placed under the adhesive chamber for the purpose of catching any dripping adhesive.

A shaft 41 is positioned in the support plate 3 in an eccentric bushing 40. A toothed belt disk 42 is wedged upon the lower shaft pegs of the shaft that protrude over support plate 3. An endless toothed belt 43 runs over the toothed belt disk 42. The toothed belt drives the toothed belt disks 44, 45 connected to adhesive rollers 6, 7.

Figure 5:
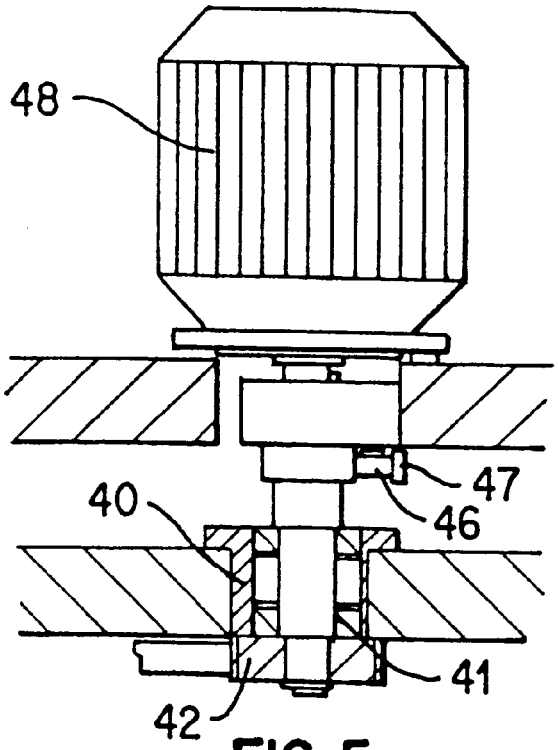
FIG. 5 is a profile through the plate and support plate shown in FIGS. 3 and 4 with the drive of the adhesive application rollers.
Figure 6:
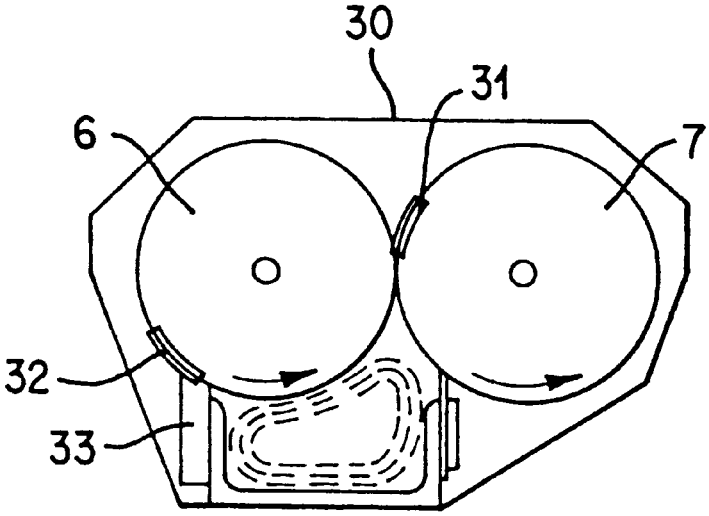
FIG. 6 is a top view of the adhesive chamber of the adhesive application device after the removal of the support plate.

A radial lever 46 is attached to the pegs of the shaft 41 that protrude over the support plate 3. The shaft 41 is driven via the lever by an eccentric crank peg 47 of a motor 48. The motor 48 is flanged upon the plate 1 as can be seen in FIG. 5.

When it is in the swung-in operating position, the support plate 3 is braced, via a stop 50, upon the plate 1 that is firmly retained in the frame.

The adhesive roller 6 transfers the adhesive to the glue application roller 53. Adhesive roller 45, which is placed against adhesive roller 44, is used to spread and distribute the adhesive and, corresponding to the width of the gap formed between the adhesive rollers, is used to adjust the thickness of the transferred adhesive film.

Reference is made to DE-195 32 582.6 for a description of the design and effect of the adhesive substance application device.

We claim:

1. An adhesive application device comprising:

a support plate, suspended and free floating adhesive rollers positioned in said support plate, a housing placed against said rollers so as to form an adhesive chamber with said rollers, a machine frame in which said support plate is positioned laterally from the adhesive rollers, a vertical shaft about which said support plate is swung, and support pieces upon which said housing is attached in a removable manner provided on the support plate.

2. The adhesive application device according to claim 1, wherein said support pieces laterally grasp said housing, and further comprising a laterally protruding clip with which said housing is provided that can be screwed together with the support pieces.

3. The adhesive application device according to claim 1, and further comprising a toothed belt disk that is attached to a shaft positioned upon said support plate, a shaft peg protruding over said support plate, a motor fixedly attached to the frame with which said shaft peg can be coupled, and an endless toothed belt driving the adhesive rollers which runs over the toothed belt disk.

4. The adhesive application device according to claim 1, wherein two of said adhesive rollers are positioned on said support plate.

5. The adhesive application device according to claim 1, and further comprising pins that are connected with said support plate on which said adhesive rollers are positioned.

6. The adhesive application device according to claim 1, wherein the adhesive rollers are positioned upon said pins by upper and lower roller bearings, the upper roller bearings being made so that they can be shifted while the lower roller bearings being made as fixed bearings so that they can be tensed against ring steps of said pins by screws that can be screwed into the pins, washers and springs.

7. The adhesive application device according claim 1, and further comprising a floor plate of the housing resting against fronts of the adhesive rollers and grooves arranged in a rim area of the fronts that rise in a wedge-shape manner toward a roller gap and an inlet-side vertical limiting edge of a side wall of said housing.

8. The adhesive application device according to claim 5, and further comprising a part of a pin that is eccentric with respect to said pin, said part of the pin being rotatably positioned in the support plate above a segment of the pin serving to support one of the adhesive rollers, and a pressure medium piston-cylinder unit for turning the part of the pin.

9. The adhesive application device according to claim 2, and further comprising a toothed belt disk that is attached to a shaft positioned upon said support plate, a shaft peg protruding over said support plate, a motor fixedly attached to the frame with which said shaft peg can be coupled, and an endless toothed belt driving the adhesive rollers which runs over the toothed belt disk.

10. The adhesive application device according to claim 2, wherein two of said adhesive rollers are positioned on said support plate.

11. The adhesive application device according to claim 3, wherein two of said adhesive rollers are positioned on said support plate.

12. The adhesive application device according to claim 2, and further comprising pins that are connected with said support plate on which said adhesive rollers are positioned.

13. The adhesive application device according to claim 3, and further comprising pins that are connected with said support plate on which said adhesive rollers are positioned.

14. The adhesive application device according to claim 4, and further comprising pins that are connected with said support plate on which said adhesive rollers are positioned.

15. The adhesive application device according to claim 9, and further comprising pins that are connected with said support plate on which said adhesive rollers are positioned.

16. The adhesive application device according to claim 10, and further comprising pins that are connected with said support plate on which said adhesive rollers are positioned.

17. The adhesive application device according to claim 11, and further comprising pins that are connected with said support plate on which said adhesive rollers are positioned.

18. The adhesive application device according claim 2, and further comprising a floor plate of the housing resting against fronts of the adhesive rollers and grooves arranged in a rim area of the fronts that rise in a wedge-shape manner toward a roller gap and an inlet-side vertical limiting edge of a side wall of said housing.

19. The adhesive application device according to claim 12, and further comprising a part of a pin that is eccentric with respect to said pin, said part of the pin being rotatably positioned in the support plate above a segment of the pin serving to support one of the adhesive rollers, and a pressure medium piston-cylinder unit for turning the part of the pin.

20. The adhesive application device according to claim 13, and further comprising a part of a pin that is eccentric with respect to said pin, said part of the pin being rotatably positioned in the support plate above a segment of the pin serving to support one of the adhesive rollers, and a pressure medium piston-cylinder unit for turning the part of the pin.

* * * * *